United States Patent [19]

Fuller et al.

[11] Patent Number: 4,952,477

[45] Date of Patent: Aug. 28, 1990

[54] TONER AND DEVELOPER COMPOSITIONS WITH SEMICRYSTALLINE POLYOLEFIN RESINS

[75] Inventors: Timothy J. Fuller, West Henrietta; Thomas W. Smith, Penfield; William M. Prest, Jr.; Robert A. Nelson, both of Webster; Kathleen M. McGrane, Rochester; Suresh K. Ahuja, Webster, all of N.Y.

[73] Assignee: Xerox Corporation, Stamford, Conn.

[21] Appl. No.: 231,338

[22] Filed: Aug. 12, 1988

[51] Int. Cl.[5] ..... G03G 9/08; G03G 9/10; G03G 13/22

[52] U.S. Cl. ..... 430/109; 430/108; 430/904; 526/348.2; 526/348.3; 526/348.4; 526/348.5

[58] Field of Search ..... 430/904, 108, 109; 526/348.2, 348.3, 348.4, 348.5

[56] References Cited

U.S. PATENT DOCUMENTS

| | | | |
|---|---|---|---|
| 3,590,000 | 6/1971 | Palermiti et al. | 252/62.1 |
| 3,720,617 | 3/1973 | Chatterji et al. | 252/62.1 |
| 3,752,666 | 8/1973 | Hagenbach et al. . | |
| 3,788,994 | 1/1974 | Wellman et al. | 252/62.1 |
| 3,853,778 | 12/1974 | Buckley et al. | 430/109 |
| 3,967,962 | 7/1976 | O'Malley | 430/120 |
| 3,983,045 | 9/1976 | Jugle et al. | 252/62.1 P |
| 4,051,077 | 9/1977 | Fisher | 252/62.1 P |
| 4,108,653 | 8/1978 | Peters . | |
| 4,197,377 | 4/1980 | Bohm et al. | 525/241 X |
| 4,233,387 | 11/1980 | Mammino et al. | 430/137 |
| 4,258,116 | 3/1981 | Takasu et al. | 430/102 |
| 4,340,684 | 7/1982 | Bohm et al. | 525/241 X |
| 4,343,918 | 8/1982 | Bohm et al. | 525/241 X |
| 4,350,795 | 9/1982 | Bohm et al. | 525/241 X |
| 4,385,107 | 5/1983 | Tanaka et al. | 430/904 X |
| 4,528,257 | 7/1985 | Polderman et al. | 430/109 |
| 4,529,680 | 7/1985 | Asanae et al. | 430/106.6 |
| 4,702,986 | 10/1987 | Imai et al. | 430/120 |

FOREIGN PATENT DOCUMENTS

| | | | |
|---|---|---|---|
| 60-123853 | 7/1985 | Japan | 430/109 |
| 62-62368 | 3/1987 | Japan | 430/109 |
| 62-273574 | 11/1987 | Japan | 430/109 |

*Primary Examiner*—Marion C. McCamish
*Assistant Examiner*—Jeffrey A. Lindeman
*Attorney, Agent, or Firm*—E. O. Palazzo; Judith L. Byarick

[57] ABSTRACT

A toner composition comprised of resin particles selected from the group consisting of a semicrystalline polyolefin and copolymers thereof which a melting point of from about 50° C. to about 100° C., and pigment particles.

53 Claims, No Drawings

TONER AND DEVELOPER COMPOSITIONS WITH SEMICRYSTALLINE POLYOLEFIN RESINS

BACKGROUND OF THE INVENTION

This invention is generally directed to toner compositions, and more specifically, the present invention relates to developer compositions having incorporated therein toner compositions comprised of semicrystalline polyolefin resins. More specifically, in one embodiment of the present invention there are provided developer compositions formulated by admixing toner compositions containing polyolefin toner polymeric resins, and carrier components. In one specific embodiment of the present invention there are provided toner compositions with a semicrystalline polyolefin resin, alpha-olefin polymers, copolymers, or mixtures, thereof, which components are nontoxic, nonblocking at temperatures of less than 50° C., for example, jettable or processable into toner compositions by other means, melt fusable with a broad fusing temperature latitude, cohesive above the melting point of the resin, and triboelectrically chargable. Moreover, in addition the toner compositions of the present invention possess lower fusing temperatures, and therefore lower fusing energies are required for fixing thus enabling less power consumption during fusing, and permitting extended lifetimes for the fuser systems selected. Accordingly, thus the toners of the present invention can be fused (fuser roll set temperature) at temperatures of 225° F. or less as compared to many currently commercially available toners which fuse at temperatures of from about 300° to about 325° F. With further respect to the present invention, the semicrystalline alpha-olefin polymers or copolymers selected have a melting point of from about 50° to about 100° C., and preferably from about 60° to about 80° C. as determined by DSC and by other known methods. Also, the toner, and developer compositions of the present invention are particularly useful in electrophotographic imaging and printing systems, especially xerographic imaging processes.

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith, as it is these values the enable continued constant developed images of high quality and excellent resolution; and admixing characteristics. Specifically, thus toner and developer compositions are known, wherein there are selected as the toner resin styrene acrylates, styrene methacrylates, and certain styrene butadienes including those available as Pliolites. Other resins have also have been selected for incorporation into toner compositions inclusive of the polyesters as illustrated in U.S. Pat. No. 3,590,000. Moreover, it is known that single component magnetic toners can be formulated with styrene butadiene resins, particularly those resins available as Pliolite. In addition, positively charged toner compositions containing various resins, inclusive of certain styrene butadienes and charge enhancing additives, are known. For example, there are described in U.S. Pat. No. 4,560,635, the disclosure of which is totally incorporated herein by reference, positively charged toner compositions with distearyldimethyl ammonium methylsulfate charge enhancing additives. This patent also illustrates the utilization of suspension polymerized styrene butadienes for incorporation into toner compositions, reference for example working Example IX.

Numerous patents are in existance that illustrate toner compositions with various types of toner resins including, for example, 4,104,066, polycaprolactones; 3,547,822, polyesters; 4,049,447, polyesters; 4,007,293, polyvinyl pyridine-polyurethane; 3,967,962, polyhexamethylene sebaccate; 4,314,931, polymethyl methacrylates; Reissue 25,136, polystyrenes; and 4,469,770, styrene butadienes.

Of particular interest in U.S. Pat. No. 4,529,680, which discloses magnetic toners for pressure fixation containing methyl-1-pentene as the main component. More specifically, there is illustrated in this patent, reference column 2, beginning at line 66, magnetic toners with polymers containing essentially methyl-1-pentene as the main component, which polymer may be a homopolymer or copolymer with other alpha-olefin components. It is also indicated in column 3, beginning at around line 14, that the intrinsic viscosity of the polymer is of a specific range, and further that the melting point of the polymer is in a range of 150° to 240° C., and preferably 180° to 230° C. Other patents of background interest located as a result of a patentability search include 3,720,617; 3,752,666; 3,788,994; 3,983,045; 4,051,077; 4,108,653; 4,258,116; and 4,558,108.

In addition, several recently issued patents illustrate toner resins including vinyl polymers, diolefins, and the like, reference for example U.S. Pat. No. 4,560,635. Moreover, there is illustrated in U.S. Pat. No. 4,469,770 toner and developer compositions wherein there is incorporated into the toner styrene butadiene resins prepared by emulsion polymerization processes.

Furthermore, a number of different carrier particles have been illustrated in the prior art, reference for example the 3,590,000 patent mentioned herein; and U.S. Pat. No. 4,233,387, the disclosure of which is totally incorporated herein by reference, wherein coated carrier components for developer mixtures, which are comprised of finely divided toner particles clinging to the surface of the carrier particles, are recited. Specifically, there is disclosed in this patent coated carrier particles obtained by mixing carrier core particles of an average diameter of from between about 30 microns to about 1,000 microns with from about 0.05 percent to about 3.0 percent by weight based on the weight of the coated carrier particles of thermoplastic resin particles. More specifically, there are illustrated in the '387 patent processes for the preparation of carrier particles by a powder coating process; and wherein the carrier particles consist of a core with a coating thereover comprised of polymers. The carrier particles selected can be prepared by mixing low density porous magnetic, or magnetically attractable metal core carrier particles with from, for example, between about 0.05 percent and about 3 percent by weight based on the weight of the coated carrier particles of a polymer until adherence thereof to the carrier core by mechanical impaction or electrostatic attraction; heating the mixture of carrier core particles and polymer to a temperature, for example, of between from about 200° F. to about 550° F. for a period of from about 10 minutes to about 60 minutes enabling the polymer to melt and fuse to the carrier core particles; cooling the coated carrier particles; and thereafter classifying the obtained carrier particles to a desired particle size. In copending applications U.S. Ser. Nos. 136,792 and 136,791, the disclosures of which are totally incorporated herein by reference, there are disclosed carrier particles comprised of a core with a coating thereover comprised of a mixture of a first dry polymer component and a second dry polymer component not in close proximity to the first polymer in the triboelectric series. Therefore, the aforementioned carrier compositions can be comprised of known core materials including iron with a dry polymer coating mixture thereover. Subsequently, developer compositions can be generated by admixing the aforementioned carrier particles with a toner composition comprised of resin particles and pigment particles.

In copending application U.S. Ser. No. 751,922 entitled Developer Compositions With Specific Carrier Particle Developers, the disclosure of which is totally incorporated herein by reference, there are illustrated toners with styrene butadiene copolymers, pigment particles inclusive of magnetites, charge control additives, and carrier particles containing a core with a coating thereover of vinyl copolymers, or homopolymers such as vinyl chloride/vinyl acetate.

Other patents of interest include 3,939,086, which teaches steel carrier beads with polyethylene coatings, see column 6; 3,533,835; 3,658,500; 3,798,167; 3,918,968; 3,922,382; 4,238,558; 4,310,611; 4,397,935; and 4,434,220.

Although the above described toner compositions and resins are suitable for their intended purposes, in most instances there continues to be a need for toner and developer compositions containing new resins. More specifically, there is a need for toners, which can be fused at lower energies than many of the presently available resins selected for toners. There is also a need for resins that can be selected for toner compositions which are low cost, nontoxic, nonblocking at temperatures of less than 50° C., jettable, melt fusible with a broad fusing latitude, cohesive above the melting temperature, and triboelectrically chargable. In addition, there remains a need for toner compositions which can be fused at low temperatures, that is for example 25° F. (275° F., for example) or less, as compared to those presently in commercial use, which require fusing temperature of about 300° to 325° F., thereby enabling with the compositions of the present invention the utilization of lower fusing temperatures, and lower fusing energies permitting less power consumption during fusing, and allowing the fuser system, particularly the fuser roll selected, to possess extended lifetimes. Another need resides in the provision of developer compositions comprised of the toner compositions illustrated herein, and carrier particles. There also remains a need for toner and developer compositions containing additives therein, for example charge enhancing components, thereby providing positively, or negatively charged toner compositions. Furthermore, there is a need for toner and developer compositions with semicrystalline polyolefin polmers that will enable the generation of solid image area with substantially no background deposits, and full gray scale production of half tone images in electrophotographic imaging and printing systems.

There is also a need for semicrystalline alpha-olefin polymers, copolymers thereof, and mixtures of the aforementioned polymers and copolymers with melting points of from about 50° to about 100° C., and preferably from about 60° to about 80° C.; and wherein toner compositions containing the aforementioned resins can be formulated into developer compositions which are useful in electrophotographic imaging and printing systems, and wherein fusing can, for example, be accomplished by flash, radiant, with heated ovens, and cold pressure fixing methods.

SUMMARY OF THE INVENTION

It is an object of the present invention to provide toner and developer compositions which possess many of the advantages illustrated herein.

In another object of the present invention there are provided developer compositions with positively charged toners containing therein semicrystalline polyolefin resins.

Also, in another object of the present invention there are provided toner compositions containing therein a semicrystalline alpha-olefin polymer, or copolymers as resinous components, which components have a melting point of from about 50° to about 100° C., and preferably from about 60° to about 80° C.

Further, in an additional object of the present invention there are provided developer compositions comprised of toners having incorporated therein semicrystalline polyolefin resins, and carrier particles.

Furthermore, in another object of the present invention there are provided improved toner compositions which can be fused at lower temperatures thereby reducing the amounts of energy needed for affecting fusing of the image developed.

Moreover, in another object of the present invention there are provided developers with positively charged toner compositions that possess excellent electrical properties.

Also, in another object of the present invention there are provided developers with stable triboelectric charging characteristics for extended time periods exceeding, for example, 500,000 imaging cycles.

Another object of the present invention resides in the provision of toner compositions with excellent blocking temperatures, and acceptable fusing temperature latitudes.

In another object of the present invention there are provided toner and developer compositions that are nontoxic, nonblocking at temperatures of less than 50° F, jettable, melt fusible with a broad fusing latitude, and cohesive above the melting temperature thereof.

Furthermore, in an additional object of the present invention there are provided developer compositions containing carrier particles with a coating thereover consisting of a mixture of polymers that are not in close proximity in the triboelectric series, reference U.S. Ser. No. 136,792 and U.S. Ser. No. 136,791, the disclosures of which are totally incorporated herein by reference.

Also, in yet still another object of the present invention there are provided methods for the development of electrostatic latent images with toner compositions containing therein semicrystalline alpha-polyolefin resin particles.

In yet another object of the present invention there are provided developer compositions with carrier components obtained by a dry coating process, which particles possess substantially constant conductivity parameters, and a wide range of preselected triboelectric charging values.

Furthermore, in yet a further object of the present invention there are provided developer compositions with carrier particles comprised of a coating with a mixture of polymers that are not in close proximity, that is for example, a mixture of polymers from different positions in the triboelectric series, and wherein the toner compositions incorporated therein possess excellent admix charging values of, for example, less than one minute, and triboelectric charges thereon of from about 15 to about 35 microcoulombs per gram.

Another object of the present invention resides in the provision of toner and developer compositions which are insensitive to humidity of from about 20 to about 80 percent, and which compositions possess superior aging characteristics enabling their utilization for a substantial number of imaging cycles with very little modification of the triboelectrical properties, and other characteristics.

Also, in another object of the present invention there are provided low melting toner compositions.

In still another object of the present invention there are provided toner and developer compositions for affecting development of images in electrophotographic imaging apparatus, including xerographic imaging, and printing processes.

These and other objects of the present invention are accomplished by providing toner and developer compositions containing therein certain polyolefin resins. More specifically, in one embodiment of the present invention there are provided toner compositions comprised of pigment particles, and semicrystalline resin polyolefin polymers, especially semicrystalline alpha-olefin polymers, copolymers, and mixtures thereof. The aforementioned polyolefins have a melting point of from about 50° to about 100° C., and preferably from about 60° to about 80° C. as determined by DSC are preferred.

More specifically the semicrystalline polyolefin polymer or polymers with a melting point of from about 50° to about 100° C., and preferably from about 60° to about 80° C. selected for the toner compositions of the present invention are illustrated with respect to the following formulas wherein X is a number of from about 250 to about 21,000; the number average molecular weight is from about 17,500 to and 1,500,000 as determined by GPC; and the $M_w/M_n$ dispersability ratio is from about 2 to about 15.

I. Polypentenes-$(C_5H_{10})_x$
II. Polytetradecenes-$(C_{14}H_{28})_x$
III. Polypentadecenes-$(C_{15}H_{30})_x$
IV. Polyhexadecenes-$(C_{16}H_{32})_x$
V. Polyheptadecenes-$(C_{17}H_{34})_x$
VI. Polyocatdecenes-$(C_{18}H_{36})_x$
VII. Polynonadecenes-$(C_{19}H_{38})_x$
VIII. Polyeicosenes-$(C_{20}H_{40})_x$ Examples of specific semicrystalline polyolefin polymers include poly-1-pentene; poly-1-tetradecene; poly-1-pentadecene; poly-1-hexadecene; poly-1-heptadecene; poly-1-octadene; poly-1-nonadecene; poly-1-eicosene; mixtures thereof; and the like. Other semicrystalline polyolefins can be selected providing the objectives of the present invention are achieved, and providing these polyolefins have a melting point of from about 50° to about 100° C., and preferably from about 60° to about 80° C.

Copolymers can also be selected as the resin components for the present invention providing they have the melting point as indicated, that is from about 50° to about 100° C. and preferably from about 60° to 80° C., which copolymers are formed from two monomers. Generally the copolymers contain from about 80 to about 99.5 mole percent of the aforementioned polypentene monomer, and from about 0.5 to 15 mole percent of the polyolefin polymers of Formulas I through VIII illustrated herein. Also, the copolymers can be specifically comprised of ethylene, propylene, and butene based copolymers with melting points between 50° and 100° C. These copolymers usually consume less energy, that is for example their heat of fusion is less than the polymers, a high heat of fusion being about 250 Joules/-gram; the heat of fusion being the amount of heat needed to effectively and permanently fuse the toner composition to a supporting substrate such as paper. In addition, the aforementioned copolymers generally possess a number average molecular weight of from about 17,000 to about 1,500,000, and have a dispersability $M_w/M_n$ ratio of about 2 to about 15. The semicrystalline polyolefins and copolymers thereof, and mixtures are available from a number of sources; and methods for the preparation of these compounds are illustrated in numerous published references, see for example U. Giannini, G. Bruckner, E. Pellino, and A. Cassatta, *Journal of Polymer Science*, Part C (22), pages 157 to 175 (1968); and K. J. Clark, A. Turner Jones, and G. G. H. Sandiford, *Chemistry in Industry*, pages 2010 to 2012 (1962), the disclosure of each of these articles being totally incorporated herein by reference. With mixtures, from about 75 to about 95 percent by weight of the polymer is selected, and from about 5 percent to about 30 percent by weight of the copolymer can be selected; however, other mixtures can be utilized providing the objectives of the present invention are achieved.

The aforementioned toner resin semicrystalline polyolefins or copolymers thereof are generally present in the toner composition in various effective amounts depending, for example, on the amount of the other components, and providing the objectives of the present invention are achievable. Generally, from about 70 to about 95 percent by weight of the resin is present, and preferably from about 80 to about 90 percent by weight.

Numerous well known suitable pigments or dyes can be selected as the colorant for the toner particles including, for example, carbon black, nigrosine dye, lamp black, iron oxides, magnetites, and mixtures thereof. The pigment, which is preferably carbon black, should be present in a sufficient amount to render the toner composition highly colored. Thus, the pigment particles are present in amounts of from about 2 percent by weight to about 20 percent by weight, based on the total weight of the toner composition, however, lesser or greater amounts of pigment particles can be selected providing the objectives of the present invention are achieved.

Various magnetities, which are comprised of a mixture of iron oxides ($FeO \cdot Fe_2O_3$) in most situations include those commercially available such as Mapico Black, can be selected for incorporation into the toner compositions illustrated herein. The aforementioned pigment particles are present in various effective amounts; generally, however, they are present in the toner composition in an amount of from about 10 percent by weight to about 30 percent by weight, and preferably in an amount of from about 16 percent by weight to about 19 percent by weight. Other magnetites not specifically disclosed herein may be selected provided the objectives of the present invention are achievable.

A number of different charge enhancing additives may be selected for incorporation into the toner compositions of the present invention to enable these compositions to acquire a positive charge thereon of from, for example, about 10 to about 35 microcoulombs per gram. Examples of charge enhancing additives include alkyl pyridinium halides, especially cetyl pyridinium chloride, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium methyl sulfate reference U.S. Pat. No. 4,560,635, the disclosure of which is totally incorporated herein by reference; and other similar known charge enhancing additives. These additives are usually incorporated into the toner in an amount of from about 0.1 percent by weight to about 15 percent by weight, and preferably these additives are present in an amount of from about 0.2 percent by weight to about 5 percent by weight.

Moreover, the toner composition can contain as internal or external components other additives such as colloidal silicas inclusive of Aerosil, metal salts of fatty acids such as zinc stearate, metal salts, reference U.S. Pat. Nos. 3,590,000 and 3,900,588, the disclosures of which are totally incorporated herein by reference, and waxy components, particularly those with a molecular weight of from about 1,000 to about 15,000, and preferably from about 1,000 to about 6,000 such as polyethylene and polypropylene, which additives are generally present in an amount of from about 0.1 to about 1 percent by weight.

The toner composition of the present invention can be prepared by a number of known methods including melt blending the toner resin particles, and pigment particles or colorants, followed by mechanical attrition. Other methods include those well known in the art such as spray drying, melt dispersion, dispersion polymerization, extrusion, and suspension polymerization. In one dispersion polymerization method, a solvent dispersion of the resin particles and the pigment particles are spray dried under controlled conditions to result in the desired product.

Important characteristics associated with the toner compositions of the present invention include a fusing temperature of less than about 225° F., and a fusing temperature latitude of from about 200° to about 350° F. Moreover, it is believed that the aforementioned toners posses stable triboelectric charging values of from about 10 to about 35 microcoulombs per gram for an extended number of imaging cycles, exceeding, for example, in some embodiments one million developed copies. Although it is not desired to be limited by theory, it is believed that two important factors for the slow, or substantially no degradation in the triboelectric charging values reside in the unique physical properties of the polyolefin resin selected, and moreover the stability of the carrier particles utilized. Also of importance is the consumption of less energy with the toner compositions of the present invention since they can be fused at a lower temperature, that is about 225° F. (fuser roll set temperature) compared with other conventional toners including those containing styrene butadiene resins which fuse at from about 300° to about 330° F. In addition, the semicrystalline polyolefin polymers and copolymers possess the other important characteristics mentioned herein inclusive of a melting point range of from about 50 to about 100, and preferably from about 60° to about 80° C.

As carrier particles for enabling the formulation of developer compositions when admixed with the toner described herein, there are selected various known components including those wherein the carrier core is comprised of steel, nickel, magnetites, ferrites, copper zinc ferrites, iron, polymers, mixtures thereof, and the like. Also useful are the carrier particles prepared by a powder coating process as illustrated in copending applications U.S. Ser. No. 136,792 and U.S. Ser. No. 136,791, the disclosures of which are totally incorporated herein by reference. More specifically, these carrier particles can be prepared by mixing low density porous magnetic, or magnetically attractable metal core carrier particles with from, for example, between about 0.05 percent and about 3 percent by weight, based on the weight of the coated carrier particles, of a mixture of polymers until adherence thereof to the carrier core by mechanical impaction or electrostatic attraction; heating the mixture of carrier core particles and polymers to a temperature, for example, of between from about 200° F. to about 550° F., for a period of from about 10 minutes to about 60 minutes enabling the polymers to melt and fuse to the carrier core particles; cooling the coated carrier particles; and thereafter classifying the obtained carrier particles to a desired particle size.

In a specific embodiment of the present invention, there are provided carrier particles comprised of a core with a coating thereover comprised of a mixture of a first dry polymer component and a second dry polymer component. Therefore, the aforementioned carrier compositions can be comprised of known core materials including iron with a dry polymer coating mixture thereover. Subsequently, developer compositions of the present invention can be generated by admixing the aforementioned carrier particles with the toner compositions comprised of the polyolefin resin particles and pigment particles.

Thus, a number of suitable solid core carrier materials can be selected providing the objectives of the present invention are obtained. Characteristic carrier properties of importance include those that will enable the toner particles to acquire a positive charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics. Preferred carrier cores include ferrites, and sponge iron, or steel grit with an average particle size diameter of from between about 30 microns to about 200 microns.

Illustrative examples of polymer coatings selected for the carrier particles of the present invention include those that are not in close proximity in the triboelectric series. Specific examples of polymer mixtures selected are polyvinylidenefluoride with polyethylene; polymethylmethacrylate and copolyethylenevinylacetate; copolyvinylidenefluoride tetrafluoroethylene and polyethylene; polymethylmethacrylate and copolyethylene vinylacetate; and polymethylmethacrylate and polyvinylidenefluoride. Other coatings, such as polyvinylidene fluorides, flourocarbon polymers including those available as FP-461, terpolymers of styrene, methacrylate, and triethoxy silane, polymethacrylates, reference U.S. Pat. Nos. 3,467,634 and 3,526,533, the disclosures of which are totally incorporated herein by reference, and not specifically mentioned herein can be selected providing the objectives of the present invention are achieved.

With further reference to the polymer coating mixture, by close proximity as used herein it is meant that the choice of the polymers selected are dictated by their position in the triboelectric series, therefore for example, one may select a first polymer with a significantly lower triboelectric charging value than the second polymer.

The percentage of each polymer present in the carrier coating mixture can vary depending on the specific components selected, the coating weight and the properties desired. Generally, the coated polymer mixtures used contain from about 10 to about 90 percent to the first polymer, and from about 90 to about 10 percent by weight of the second polymer. Preferably, there are selected mixtures of polymers with from about 30 to about 60 percent by weight of the first polymer, and from about 70 to about 40 percent by weight of a second polymer. In one embodiment of the present invention, when a high triboelectric charging value is desired, that is exceeding 30 microcoulombs per gram, there is selected from about 50 percent by weight of the first polymer such as a polyvinylidene fluoride commercially available as Kynar 310° F.; and 50 percent by weight of a second polymer such as polymethylacrylate or polymethylmethacrylate. In contrast, when a lower triboelectric charging value is required, less than, for example, about 10 microcoulombs per gram, there is selected from about 30 percent by weight of the first polymer, and 70 percent by weight of the second polymer.

Generally, from about 1 part to about 5 parts by weight of toner particles are mixed with from about 10 to about 300 parts by weight of the carrier particles illustrated herein enabling the formation of developer compositions.

Also encompassed within the scope of the present invention are colored toner compositions comprised of toner resin particles, carrier particles, and as pigments or colorants, magenta, cyan and/or yellow particles, as well as mixtures thereof. More specifically, illustrative examples of magenta materials that may be selected as pigments include 1,9-dimethyl-substituted quinacridone and anthraquinone dye identified in the Color Index as Cl 60720; Cl Dispersed Red 15, a diazo dye identified in the Color Index as Cl 26050; Cl Solvent Red 19; and the like. Examples of cyan materials that may be used as pigments include copper tetra-4(octadecyl sulfonamido) phthalocyanine; X-copper phthalocyanine pigment listed in the Color Index as Cl 74160; Cl Pigment Blue; and Anthrathrene Blue, identified in the Color Index as Cl 69810; Special Blue X-2137; and the like; while illustrative examples of yellow pigments that may be selected are diarylide yellow 3,3-dichlorobenzidene acetoacetanilides, a monoazo pigment identified in the Color Index as Cl 12700; Cl Solvent Yellow 16, a nitrophenyl amine sulfonamide identified in the Color Index as Foron Yellow SE/GLN; Cl Dispersed Yellow 33, a 2,5-dimethoxy-4-sulfonanilide phenylazo-4'-chloro-2,5-dimethoxy acetoacetanilide; Permanent Yellow FGL; and the like. These pigments are generally present in the toner composition in an amount of from about 1 weight percent to about 15 weight percent based on the weight of the toner resin particles.

The toner and developer compositions of the present invention may be selected for use in electrophotographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules there can be selected the aryl amines disclosed in the '990 patent. Also, there can be selected as photogenerating pigments, squaraine compounds, azo pigments, perylenes, thiapyrillium materials, and the like. These layered member are conventionally charged negatively, thus usually a positively charged toner is selected for development. Moreover, the developer compositions of the present invention are particularly useful in electrophotographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference. Images obtained with the developer compositions of the present invention possess acceptable solids, excellent halftones and desirable line resolution with acceptable or substantially no background deposits.

The following examples are being supplied to further define the present invention, it being noted that these examples are intended to illustrate and not limit the scope of the present invention. Parts and percentages are by weight unless otherwise indicated.

Generally, for the preparation of toner compositions there was initially obtained from commercial sources the semicrystalline resin polymer particles. Additionally, these polymers can be prepared as illustrated herein. Thereafter, there are admixed with the resin polymer pigment particles and other additives by, for example melt extrusion, and the resulting toner particles are classified and jetted to enable toner particles, preferably with an average volume diameter of from about 10 to about 20 microns.

EXAMPLE I

Poly-Alpha-Olefin Preparation

Reagents: All olefins, diethylaluminum chloride (25 weight percent solution in toluene), and toluene were used as received from Aldrich, Inc., Texas Alkyls, Inc., Shell Corporation, and Chevron Corporation. Titanium (III) chloride, aluminum reduced, was obtained from Alfa, Inc. or Stauffer Chemical Company. A typical experimental procedure that was followed to prepare laboratory quantities of polyolefins is described in the following preparation of poly-1-pentene. Other polymers were similarly prepared following the general procedure described for the preparation of poly-1-olefins.

General Preparation And Characterization Of Poly-1-olefins

All of the semicrystalline polyolefins, copolymers thereof, or other polyolefins were prepared by the process illustrated in U. Giannini, G. Bruckner, E. Pellino and A. Cassatta, *J. Polymer Sci.*: Part C, (22) 157 to 175 (1968), and K. J. Clark, A. Turner Jones, and D. J. H. Sandiford, *Chemistry and Industry,* 2010 to 2012 (1962), the disclosures of which are totally incorporated herein by reference. More specifically, an alpha-olefin (10 grams) was charged into a suitable reaction vessel containing toluene (40 milliliters). Diethylaluminum chloride (between 9 and 20 milliliters of a 1.8 molar solution in toluene obtained from Texas Alkyls, Inc. or Aldrich, Inc.) was added thereto under an inert atmosphere of argon or nitrogen, followed by the addition of a solid solution of purple titanium trichloride, 33 percent aluminum chloride (solid solution supplied by Stauffer). After between 14 and 72 hours, the reaction mixture was quenched cautiously with methanol and washed extensively with methanol, water, and then methanol using a Waring blender. The white powder obtained was then dried in vacuum to constant weight to yield between 60 and 99 percent theoretical weight of a poly-alpha-olefin. The resultant polymer, and other polymers, was were characterized with differential scanning calorimetry (DSC), solid state CP/MAS$^{13}$C nuclear magnetic resonance spectrometry, solution viscometry, gel permeation chromatography (GPC), and melt rheology analysis. Also, some of the various polyolefins prepared had GPC weight average molecular weights between about 51,000 and about 1,500,000, and number average molecular weights between about 18,000 and about 700,000. The ratios of weight average to number average molecular weights ranged between 2 and 11. Also, some of the materials, for example, polydecene, polydodecene, polytridecene, polypentadecene, and polyoctadecene, have bimodal molecular weight distributions. The DSC melting points of the various polyolefins were sharp and dependent on side chain length.

Melting points (°C. in parentheses) for several of the prepared polyolefins were polyethylene (130), polypropylene (180), polybutene (120), polypentene (71), polyheptene (17), polydecene (25), polydodecene (25), polytridecene (35), polytetradecene (50), polypentadecene (67), polyhexadecene (68), polyoctadecene (73), and polyeicosene (80). Examples of unsatisfactory high melting point polyolefins include polyethylene, polypropylene, and polybutene. The DSC crystallinity for several of the prepared polyolefins was 20 percent (polytetradecene), 25 to 35 percent (polypentene and polyhexadecene), 40 percent (polyoctadecene), and 50 percent (polyeicosene). Forty-five (45) percent crystallinity was determined for polyoctadecene using X-ray techniques.

Copolymers of various alpha-olefins were also prepared and the melting points thereof were dependent on the final composition. Specifically, pentene coreacted with 0.5 and 1 mol percent octene yielded copolymers with melting points at 54° and 62° C., respectively. Hexadecene coreacted with 5 and 10 mol percent pentene resulted in copolymers with melting points at 52° and 54° C., respectively. Hexadecene coreated with 5, 10, and 15 mol percent decene resulted in polymers with melting points at 57°, 53° and 49° C., respectively. Octadecene coreacted with 1, 5, 10, 50, 90 and 99 mol percent hexadecene provided copolymers with melting points at 71°, 70°, 69°, 62°, 64° and 65° C., respectively.

The melt viscosities of the various polyolefins are primarily dependent on chain length. In general, molten polyeicosene and polyoctadecene are an order of magnitude less viscous than molten polypentene. Molten Poly C24 to C30 alpha-olefins are nearly two orders of magnitude less viscous than molten polypentene. The complex viscosity (for example, 5,000 or $5\times10^3$ in poise) versus temperature for polypentene varies between $3\times10^4$ at 80° C. and $5\times10^3$ at 160° C. At the same temperatures of 80° and 160° C., the complex viscosities for several polyolefins are as follows: polydodecene, $1\times10^4$ and $8.5\times10^3$; polyhexadecene, $8\times10^3$ and $6.5\times10^3$; polyoctadecene, $3\times10^3$ and $1.9\times10^3$; and polyeicosene, $2\times10^3$ and $1.5\times10^3$ poise at 10 radians per second. These values compare with those determined for styrene butadiene (91/10), that is $1.7\times10^5$ at 100° C. and $6.5\times10^3$ poise at 160° C. under the same conditions. Polyolefins are highly viscoelastic, probably as a result of their high molecular weights, and polyolefins generally have essentially flat rheology profiles compared with conventional toner polymers. Intrinsic solution viscosity data for some polyolefins in toluene at 25° C. were as follows: polypentene-0.851, polydodecene-2.339, polyhexadecene-2.654, and polyoctadecene-2.015.

Preparation of Poly-1-Pentene

Under nitrogen in a glove bag, titanium (III) chloride (1.8 grams, 9.2 millimoles) was added to toluene (40 milliliters) in a 125 milliliter capacity amber sure-seal bottle (Aldrich) equipped with a bakelite screw cap and elastomer liner. With a syringe, diethylaluminum chloride (14.4 grams in 500 milliliters of toluene) was then added, followed by the rapid addition of 1-pentene (9.5 grams, 0.135 mol). The bottle was sealed and allowed to stand for 15 hours at 25° C. with occasional shaking. The reaction mixture was then heated for 5 hours between 40° and 45° C. in an oven. After cooling to 25° C., the mixture was treated with methanol to quench the reaction. Methanol (100 milliliters) containing concentrated hydrochloric acid (10 milliliters) was added and the resulting mixture was stirred in a blender. More methanol (200 milliliters) was added and blending was repeated. The polymeric top layer decanted from the methanol was washed with water in a blender until the water washes were clear. The resulting poly-1-pentene polymer was then washed with methanol, isolated by filtration, and dried in an oven at 40° C. The yield was 7.27 grams (76.5 percent) of a white polymeric material, which dissolved in warm toluene and had a DSC melting point of 71° C. The melt viscosity in poise decreased gradually between $2\times10^4$ poise at 80° C. and $4\times10^3$ poise at 160° C. using a Rheometrics Dynamic Viscometer operated at 10 radians per second. This compares with a conventional toner polymer styrene butadiene, 91 percent styrene, 9 percent butadiene with melt viscosity that drops precipitously from $10^5$ poise at 100° C. to $4\times10^3$ poise at 160° C. The GPC molecular weight of the poly-1-pentene product was determined in toluene and the $M_w/M_n$ ratio was $1.66\cdot10^5/2\cdot10^4$. Also, the solution intrinsic viscosity was 0.851 in toluene at 25° C. for the polymer pentene product.

EXAMPLE II

Bulk Preparation of Poly-1-Pentene

Under argon in a glove bag, toluene (1,600) milliliters), 1-pentene (500 grams) diethyl aluminum chloride (800 milliliters), more toluene (500 milliliters) and titanium (III) chloride (92.5 grams), were added to a 1-gallon, wide-mouth, high-density polyethylene container, and then sealed with a screw cap. The resultant mixture was shaken until the contents became warm (45° C.). The sealed vessel was then placed in an ice bath for 45 minutes with periodic shaking until the exotherm had subsided. The contents were allowed to warm to 35° C. with periodic shaking and the reaction was allowed to proceed for 16 hours at 25° C. The mixture was then added portion-wise to a 4-liter beaker situated in an ice bath, and methanol was added cautiously with stirring. When the contents of the beaker became green, the material was added to methanol in a blender to precipitate the polymer. The precipitated polymer was collected, washed with methanol in a blender, filtered, washed with water, and then methanol. The desired polymer pentene product was then isolated by filtration and dried at 60° C. in an air oven for at least 24 hours. The yield of poly-1-pentene obtained as a white powder, and which had a melting point of 71° C., was 89.4 percent. The same procedure was followed to prepare poly-1-hexadecene and poly-1-octadecene. For hexadecene (550 grams), the above process was repeated except that 51.1 grams of $TiCl_3$, 536 milliliters of $AlEt_2Cl$ and 2,2-liter toluene were used. For octadecene (500 grams), 45.5 grams of $TiCl_3$, 447 milliliters of $AlEt_2Cl$, and 2 liters of toluene were employed.

EXAMPLE III

Bulk Preparation of Poly-1-Eicosene

In a 3-liter, 3-necked round bottom flask equipped with an argon inlet, water-cooled condenser, and a mechanical stirrer was added molten 1-eicosene (200 grams), toluene (800 milliliters), and then diethylaluminum chloride (476.61 grams of a 25 weight percent solution in toluene). To this was added rapidly, titanium (III) chloride (40.2 grams) suspended in toluene (100 milliliters) using a powder funnel under standard atmosphere with an argon purge. The resultant mixture was allowed to stir under argon for 16 hours at 25° C. The mixture was then cooled with an ice bath and methanol was added dropwise to quench the reaction. The resultant gel was blended with methanol (2 liters) containing concentrated hydrochloric acid (200 milliliters). Sufficient methanol was then added to precipitate the poly-1-eicosene polymer, which was collected by filtration, and washed with water in a blender until the water washes were clear. The polymer was then blended with methanol, isolated by filtration, and dried at 40° C. in an oven. The yield was 194 grams (97.2 percent) of a fine white fibrous powder poly-1-eicosene with a melting point of 80° C.

EXAMPLE IV

Small Scale Spray Drying of Polyhexadecene and Polyoctadecene Toner

Semicrystalline polyhexadecene (melting point 68° C.) and semicrystalline polyoctadecene (melting point 73° C.) (90 percent) formulated with 10 weight percent Black Pearls L carbon black at 4 weight percent solids in toluene were spray dried to toner dimensions using a Bowen BLSA unit equipped with solvent recovery. A SS#5 fluid spray nozzle was used to atomize the feed into the top of the spray drying chamber operated with 60° C. inlet and 40° C. outlet temperature. The classified spheroidal toner particles collected had an average volume diameter of from about between 3 to about 20 microns, and a trimodal distribution of particles centered at 1.8, 4, and 10 microns. More than 75 percent of the particles had an average volume diameter of from about 5 to about 20 microns.

EXAMPLE V

Large Scale Spray Drying of Polyhexadecene Toner

Semicrystalline polyhexadecene (melting point 68° C.), 88 weight percent, 10 weight percent Black Pearls L carbon black, and 2.0 weight percent dibenzylidene sorbitol were heated to 60° C. in toluene at 4 weight percent solids. The slurry was then spray dried with a 4.5×9 feet closed cycle spray dryer at Bower Engineering (North Branch, N.J.). The slurry was added to the top of the chamber at 219 milliliters/minute via a SS#5 fluid spray nozzle. The inlet temperature was 61° C. and the outlet temperature was 40° to 42° C. The yield of classified 3 to 20 micron spheroidal toner particles was 34 percent based on solids in the feed. The yield can be appreciably increased by heating the feed slurry to 40° C. prior to introduction to the spray dryer.

Ambient Temperature Air Jetting

Polyeicosene of Example III, polyhexadecene of Example IV, and polypentene of Example II, 90 percent by weight in each instance, were formulated with 10 weight percent Black Pearls L, and processed into toner sized particles by conventional air jetting at Aljet (Plumsteadville, Pa.) with a Portable Pulvajet Laboratory Grinding System. The yields of classified toners were 50, 34 and 26 percent, respectively, at processing speeds of 10 pounds/hour. There was obtained polyeicosene toner at a slow jetting rate of 24 grams/hour compared with 1,500 grams/hour for a toner with styrene butadiene (91/9). Ability to jet can be related to the amount of crystallinity of the various polyolefin polymers. Highly crystalline polyolefins were more prone to jet than low crystalline polyolefins.

The aforementioned prepared toners contained 90 percent by weight of the semicrystalline polymer of the present invention, such as the polyeicosene, and 10 percent by weight of the carbon black particles.

EXAMPLE VI

A magnetic toner composition was prepared by melt blending followed by mechanical attrition containing 84 percent by weight of the poly-1-pentene, $M_w/M_n$ $1.66 \cdot 10^5/2 \cdot 10^4$, obtained from Example I, and 16 percent by weight of Mapico Black, a magnetite. Thereafter, the toner composition was jetted and classified resulting in toner particles with an average volume diameter of about 8 microns. A similar toner composition was prepared with the exception that it contained 74 percent by weight of the poly-1-pentene, 16 percent by weight of the Mapico Black, and 10 percent by weight of Regal ® 330 carbon black.

Other toner compositions were prepared by repeating the above processes, thus the toner compositions described in the following examples were prepared by melt mixing, followed by mechanical attrition, jetting, and classification in accordance with the aforementioned process.

EXAMPLE VII

The above semicrystalline polyolefins, 90 percent (polypentene of Example I, polyhexadecene of Example IV, polyoctadecene of Example IV, and polyeicosene of Example III) were admixed with 10 weight percent Black Pearls L or Regal® 330 carbon black, which carbon black was allowed to dissolve with heating between 40° and 60° C. in toluene or methylene chloride at 10 weight percent solids. The resultant slurries were then allowed to cool while the congealed resulting polymer was vigorously stirred using a Waring blender, a large Kady mill, and a ball mill or an attritor equipped with steel shot. The resultant slurried particles were then added to methanol, isolated by filtration, and then vacuum dried. Very small toner particles from submicron 0.5 micron to about 20 microns average diameter were achievable with an average diameter of about 10 microns being preferred. These particles could then be heat speroidized by gentle warming of a vigorously stirred aqueous suspension of the dried toner particles in the presence of Alkanox soap followed by a rapid quench with ice water. The toner particles were then isolated in each instance by filtration and dried in vacuo.

EXAMPLE VIII

Polypentene Toner Prepared Via Melt Extrusion/Melt Dispersion

Polypentene of Example I, 74 percent, was melt extruded at 130° C. with 10 weight percent Regal® 330 carbon black and 16 weight percent Mapico, and the extrudate was then ground up with dry ice using a Waring blender. The dry particles were then mixed at 25 weight percent loading with polyethyloxazoline (Dow PEOX 50) and re-extruded at 120° C. The extrudate was then pulverized with a Waring blender and stirred with water (500 milliliters per 20 grams solids). Methanol (6 milliliters) was added as needed to control foaming. After 1 hour, the water insoluble particles were isolated by filtration with a 34 micron Nylon Nitex filter cloth (Tetko), washed with water and methanol, and then dried in vacuo. The dried cake was ground up with an Aldrich coffee grinder and classified by percolation through 45 and 34 micron sieves under vacuum with a cyclone collector (Alpine). The yield of resulting toner particles between 3 and 30 microns average volume diameter was between 50 and 85 percent, respectively. More than 85 percent of the isolated toner particles were of an average diameter of from about 3 to about 7 microns.

EXAMPLE IX

Developer Compositions

Developer compositions were then prepared by admixing 2.5 parts by weight of the toner composition of Examples IV and VIII with 97.5 parts by weight of a carrier comprised of a steel core with a polymer mixture thereover containing 70 percent by weight of Kynar, a polyvinylidene fluoride, and 30 percent by weight of polymethyl methacrylate; the coating weight being about 0.9 percent. The positive triboelectric charging value of the toner as determined in the known Faraday Cage apparatus was about +20 microcoulombs per gram.

Positively charged toners were also prepared by repeating the above procedure with the exception that there was included therein 2 percent by weight of the charge enhancing additive cetyl pyridinium chloride, and 8 percent by weight of carbon black particles.

Images were then developed in a xerographic imaging test fixture with a negatively charged layered imaging member comprised of a supporting substrate of aluminum, a photogenerating layer of trigonal selenium, and a charge transport layer of the aryl amine N,N'-diphenyl-N,N'-bis(3-methylphenyl)1,1'-biphenyl-4,4'-diamine, 45 weight percent, dispersed in 55 weight percent of the polycarbonate Makrolon, reference U.S. Pat. No. 4,265,990, the disclosure of which is totally incorporated herein by reference; and there resulted images of excellent quality with no background deposits and of high resolution for an extended number of imaging cycles exceeding, it is believed, about 75,000 imaging cycles.

EXAMPLE X

Fusing Evaluations

Polyolefin toner images were fused by heated plate, flash, radiant, hot roll and cold pressure fix hardward. Polyeicosene toner flash fuses with 1.75 Joules/inch$^2$ compared with 10 Joules/inch$^2$ for a linear polyester toner, reference U.S. Pat. No. 3,590,000, the disclosure of which is totally incorporated herein by reference. Polyolefin toners (the aforementioned semicrystalline polypentene, polytetradecene, polyhexadecene, polyoctadecene or polyeicosene, 90 percent, and 10 percent by weight of carbon black) undergo radiant fusing at 15 inches per second. These toners are fixable with cold pressure fixing pressure of 400 pounds per linear inch.

Hot Roll Fusing Evaluations

Roll fusing evaluations were accomplished with a modified Fuji Xerox soft roll silicone fuser equipped with a silicone oil wick or with a modified Cheyenne fuse to which silicone oil was applied with a paper towel. Fuser set temperature was determined with an Omega pyrometer. Fuser roll speed was approximately 3 inches per second. Minimum fix temperature at which maximum fix to paper was achieved for various semicrystalline and other polyolefin toners (90 percent polyolefin, 10 percent carbon black) were as follows: 350° F. (polyethylene), 180° F. (polypentene), 135° F. (polytetradecene), 160° F. (polyhexadecene), 180° F. (polyoctadecene), 180° F. (polyeicosene), and 130° F. (poly-C24-1-olefin). For a toner, 90 percent styrene-n-butyl (58/42), 10 percent carbon black, the corresponding monomer fix temperature was 330° F. Low melt fusing characteristics of polyolefins were also evaluated with powder cloud image development and a modified Fuji Xerox soft roll fuser. Polyhexadecene (of Example IV) toner, 90 percent, 10 percent carbon black, fused with fuser roll set at 225° F. and hot offset occurred at 350° F. Polyeicosene (of Example III) toner, 90 percent, 10 percent carbon black, fused with fuser roll set temperature at 225° F. and hot offset took place at 300° F.

Example of Fusing Evaluation with Polyeicosene

Two grams of polyeicosene of Example III (90 percent) toner prepared by melt extrusion at 130° C. with 10 weight percent Regal® 330 carbon black was treated with 0.12 gram of a 1 to 1 weight ratio of Aerosil R972. A developer composition was prepared with TP-302 (Nachem) carrier particles (97.5 parts per 2.5 parts of toner) comprised of a steel core with a 70/30 Kynar/PMMA carrier (60 grams), and this developer was selected for cascade development in a Model D imaging test fixture. A 5 to 10 seconds light exposure to a "negative" target and a negative bias to transfer positive toned images from photoreceptor to paper was used. Fusing evaluations were then accomplished with a Fuji Xerox soft silicone roll fuser and a fuser set at 170° (cold offset), 180° (minimum fix temperature), 200°, 250°, 275°, 300°, 325° and 350° F. (fuser set temperature). Superior image fixing occured at 180° F. (minimum fix temperature) which was equal to that achieved at 350° F.

Pizza Oven Fusing

Toners prepared as described herein, reference Example IV, with styrene-n-butyl melthacrylate, 90 percent; carbon black, 10 percent; styrene butadiene, 90 percent (89/11); 10 percent of carbon black could not be fused in a pizza oven at 225° F., whereas toners prepared containing 90 percent of the semicrystalline polyolefins, polypentene, polytetradecene, polyhexadecene, polyoctadecene, or polyeicosene, 90 percent of polystyrene, 10 percent of carbon black, all fused readily in a pizza oven at 225° F. (30 seconds).

EXAMPLE XI

A toner and developer composition of the present invention was prepared by repeating the procedure of Example IX with the exception that there was selected as carrier particles a steel core with a coating thereover, 0.7 percent by weight of a dry mixture of 40 percent by weight of Kynar 301F, and 60 percent by weight of polymethyl methacrylate, which carrier particles were prepared as illustrated in U.S. Ser. No. 793,042, the disclosure of which is totally incorporated herein by reference. The aforementioned components were admixed for 60 minutes in a Munson MX-1 micronizer rotating at 27.5 RPM. Thereafter, the carrier particles resulting were metered into a rotating tube furnace, which was maintained at a temperature of 410° F., at a rate of 110 grams per minute. The toner after the tribo blow off measurement possessed a positive triboelectric charge thereon of +15 microcoulombs per gram.

EXAMPLE XII

A magnetic toner composition was prepared by repeating the procedure of Example VI with the exception that there was selected 76.5 percent of the resin, 4 percent of carbon black, 19 percent of magnetite, and 0.5 percent of distearyl dimethyl ammonium methyl sulfate. Subsequently, this toner was mixed with the carrier particles as prepared in Example II with the exception that the coating mixture contained 35 percent by weight of Kynar 301F, and 65 percent by weight of polymethyl methyacrylate. The toner had a positive tribo of 20 microcoulombs per gram, and a tribo degradation rate of 0.0021 hour$^{-1}$.

Other modifications of the present invention may occur to those skilled in the art subsequent to a review of the present application, and these modifications are intended to be included within the scope of the present invention.

What is claimed is:

1. A toner composition comprised of an effective amount of resin particles selected from the group consisting of a semicrystalline polyolefin homopolymer and mixtures thereof with a melting point of from about 50° C. to about 100° C., and pigment particles.

2. A toner composition in accordance with claim 1 wherein the semicrystalline polyolefin is of the formula $(C_5H_{10})_x$ wherein x is a number of from about 250 to about 21,000.

3. A toner composition in accordance with claim 1 wherein the polyolefin is selected from the group consisting of those with the following formulas $(C_{14}H_{28})_x$; $(C_{15}H_{30})_x$; $(C_{16}H_{32})_x$; $(C_{17}H_{34})_x$; $(C_{18}H_{36})_x$; $(C_{19}H_{38})_x$; and $(C_{20}H_{40})_x$; wherein x is a number of from about 250 to about 21,000.

4. A toner composition in accordance with claim 1 wherein the polyolefin is selected from the group consisting of polypentene, polytetradecene, polypentadecene, polyhexadecene, polyheptadecene, polyoctadecene, polynonadecene, polyeicosene, and mixtures thereof.

5. A toner composition which comprises pigment particles and resin particles selected from the group consisting of semicrystalline polyolefin homopolymers, wherein the melting point of the resin particles is from about 60° to about 80° C.

6. A toner composition in accordance with claim 5 wherein the pigment particles are selected from the group consisting of carbon black, magnetites, and mixtures thereof.

7. A toner composition in accordance with claim 5 wherein the pigment particles are carbon black.

8. A toner composition in accordance with claim 5 wherein the pigment particles are comprised of magnetites.

9. A toner composition in accordance with claim 5 wherein the pigment particles are selected from the group consisting of cyan pigment particles, magenta pigment particles, yellow pigment particles, and mixtures thereof.

10. A toner composition in accordance with claim 5 containing charge enhancing additives.

11. A toner composition in accordance with claim 10 wherein the charge enhancing additives are selected from the group consisting of alkyl pyridinium halides, organic sulfates, organic sulfonates, and distearyl dimethyl ammonium methyl sulfate.

12. A toner composition in accordance with claim 10 wherein the charge enhancing additive is present in an amount of from about 0.1 to about 10 percent by weight.

13. A toner composition in accordance with claim 5 wherein the triboelectric charge on the toner is from about 5 to about 35 microcoulombs per gram.

14. A method of developing images which comprises the formation of an electrostatic latent image on a photoconductive member; developing the resulting image with the toner composition of claim 5; subsequently transferring the developed image to a suitable substrate; and thereafter permanently affixing the image thereto.

15. A method of imaging in accordance with claim 14 wherein the developer composition maintains its electrical characteristics for one million copies.

16. A toner composition which comprises pigment particles and resin particles comprised of semicrystalline polyolefins with a melting point of from about 50° C. to about 100° C., wherein the resin particles are of a number average molecular weight of from about 17,500 to about 1,500,000.

17. A toner composition in accordance with claim 16 wherein the resin particles dispersing ratio $M_w/M_n$ is from about 2 to about 15.

18. A toner composition which comprises pigment particles and resin particles comprised of semicrystalline polyolefins with a melting point of from about 50° C. to about 100° C., wherein the resin particles are present in an amount of from about 70 to about 90 percent by weight.

19. A toner composition which comprises pigment particles and resin particles comprised of semicrystalline polyolefins with a melting point of from about 50° C. to about 100° C., wherein the pigment particles are present in an amount of from about 2 to about 20 percent by weight.

20. A toner composition which comprises pigment particles, resin particles comprised of semicrystalline polyolefins with a melting point of from about 50° C. to about 100° C., and charge enhancing additives.

21. A toner composition in accordance with claim 20 wherein the charge enhancing additives are selected from the group consisting of alkyl pyridinium halides, organic sulfates, organic sulfonates, and distearyl dimethyl ammonium methyl sulfate.

22. A toner composition in accordance with claim 21 wherein the charge enhancing additive is cetyl pyridinium chloride.

23. A toner composition which comprises pigment particles and resin particles selected from the group consisting of semicrystalline polyolefins with a melting point of from about 50° C. to about 100° C., wherein the toner composition has a fusing temperature of about 225° C.

24. A developer composition which comprises carrier particles and toner particles comprising pigment particles and resin particles selected from the group consisting of a semicrystalline polyolefin and mixtures thereof with a melting point of from about 50° C. to about 100° C.

25. A developer composition in accordance with claim 24 wherein the carrier particles are comprised of a core of steel, iron, or ferrites.

26. A developer composition in accordance with claim 24 wherein the carrier particles include thereover a polymeric coating.

27. A developer composition in accordance with claim 24 wherein the pigment particles for the toner are carbon black, magnetites, or mixtures thereof.

28. A developer composition in accordance with claim 24 wherein the toner contains a charge enhancing additive selected from the group consisting of alkyl pyridinium halides, organic sulfates, and sulfonates, and distearyl dimethyl ammonium methylsulfate.

29. A developer composition in accordance with claim 28 wherein the charge enhancing additive is cetyl pyridinium chloride.

30. A developer composition in accordance with claim 24 wherein the carrier particles are prepared by a process which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F., whereby the polymer mixture melts and fuses to the carrier core particles; and (4) thereafter cooling the resulting coated carrier particles.

31. A method for developing images which comprises the formation of an electrostatic latent image on a photoconductive member; developing the resulting image with a toner composition which comprises pigment particles, resin particles comprised of semicrystalline polyolefins with a melting point of from about 50° C. to about 100° C.; subsequently transferring the developed image to a suitable substrate; and thereafter permanently affixing the image thereto.

32. A toner composition comprised of an effective amount of resin particles and pigment particles wherein the resin particles are comprised of semicrystalline copolymers of polyolefins containing as one monomer unit polypentene present in an amount of from about 85 to about 99.5 mole percent; and as the second monomer unit polytetradecene, polypentadecene, polyhexadecene, polyheptadecene, polyoctadecene, polynonadecene, or polyeicosene present in an amount of from about 0.5 to about 15 mole percent; wherein said copolymer resin particles have a melting point of from about 50° to about 100° C.

33. A toner composition in accordance with claim 32 wherein the pigment particles are selected from the group consisting of carbon black, magnetities, or mixtures thereof.

34. A toner composition in accordance with claim 32 wherein the polypentene is of the formula $(C_5H_{10})_x$ wherein x is a number of from about 250 to about 21,000.

35. A toner composition according to claim 32 wherein the copolymers are linear copolymers.

36. A toner composition which comprises pigment particles and resin particles comprising copolymers of polyolefins containing as one monomer unit polypentene present in an amount of from about 85 to about 99.5 mole percent and as the second monomer unit polytetradecene, polypentadecene, polyhexadecene, polyheptadecene, polyoctadecene, polynonadecene, or polyeicosene present in an amount of from about 0.5 to about 15 mole percent, wherein the number average molecular weight of the copolymer resin particles is from about 17,500 to about 1,500,000 and wherein the copolymer resin particles have a melting point of from about 50° to about 100° C.

37. A developer composition which comprises carrier particles and toner particles which comprise pigment particles and resin particles comprising copolymers of polyolefins containing as one monomer unit polypentene present in an amount of from about 85 to about 99.5 mole percent and as the second monomer unit polytetradecene, polypentadecene, polyhexadecene, polyheptadecene, polyoctadecene, polynonadecene, or polyeicosene present in an amount of from about 0.5 to about 15 mole percent, wherein the copolymer resin particles have a melting point of from about 50° to about 100° C.

38. A developer composition in accordance with claim 37 wherein the carrier particles contain a core selected from the group consisting of iron, steel, and ferrites.

39. A developer composition in accordance with claim 37 wherein the carrier particles include a polymeric coating thereover.

40. A toner composition comprising pigment particles and an effective amount of resin particles comprised of a semicrystalline copolymer of olefin monomers or mixtures thereof, said resin particles having a melting point of from about 50° C. to about 100° C.

41. A toner composition in accordance with claim 40 wherein the copolymers are linear copolymers.

42. A toner composition comprising pigment particles and resin particles comprised of a semicrystalline copolymer of olefin monomers or semicrystalline copolymers of olefin monomers, said resin particles having a melting point of from about 60° C. to about 80° C.

43. A toner composition comprising pigment particles and resin particles comprised of semicrystalline copolymers of olefin monomers, said resin particles having a melting point of from about 50° C. to about 100° C., and wherein the resin particles are of a number average molecular weight of from about 17,500 to about 1,500,000.

44. A toner composition comprising pigment particles and resin particles comprised of semicrystalline copolymers of olefin monomers, said resin particles having a melting point of from about 50° C. to about 100° C., wherein the resin particles are present in an amount of from about 70 to about 90 percent by weight.

45. A toner composition comprising pigment particles and resin particles selected from the group consisting of semicrystalline copolymers of olefin monomers, said resin particles having a melting point of from about 50° C. to about 100° C., wherein the pigment particles are present in an amount of from about 2 to about 20 percent by weight.

46. A toner composition comprising pigment particles, charge enhancing additives, and resin particles selected from the group consisting of semicrystalline copolymers of olefin monomers, said resin particles having a melting point of from about 50° C. to about 100° C.

47. A toner composition comprising pigment particles and resin particles selected from the group consisting of semicrystalline copolymers of olefin monomers, said resin particles having a melting point of from about 50° C. to about 100° C., wherein the toner composition has a fusing temperature of about 225° F.

48. A developer composition comprising carrier particles and a toner composition which comprises pigment particles and resin particles selected from the group consisting of semicrystalline copolymers of olefin monomers, said resin particles having a melting point of from about 50° C. to about 100° C.

49. A method for developing images which comprises the formation of an electrostatic latent image on a photoconductive member, developing the resulting image with a toner composition which comprises pigment particles and resin particles selected from the group consisting of semicrystalline copolymers of olefin monomers, said resin particles having a melting point of from about 50° C. to about 100° C., subsequently transferring the developed image to a suitable substrate, and thereafter permanently affixing the image thereto.

50. A toner composition comprising a pigment and an effective amount of a semicrystalline polyolefin homopolymer with a melting point of from about 50° C. to about 100° C.

51. A developer composition which comprises carrier particles and the toner composition of claim 50.

52. A toner composition comprising a pigment and an effective amount of a semicrystalline copolymer containing an olefin monomer, said copolymer having a melting point of from about 50° C. to about 100° C.

53. A developer composition which comprises carrier particles and the toner composition of claim 52.

* * * * *